US006692299B1

(12) United States Patent
Stockmaster

(10) Patent No.: US 6,692,299 B1
(45) Date of Patent: Feb. 17, 2004

(54) ELECTRICAL CONNECTOR FOR COAXIAL CABLE

(75) Inventor: David Stockmaster, Elizabethtown, KY (US)

(73) Assignee: Hitachi Cable Indiana, Inc., New Albany, IN (US)

( * ) Notice: Subject to any disclaimer, the term of this patent is extended or adjusted under 35 U.S.C. 154(b) by 0 days.

(21) Appl. No.: 10/287,557

(22) Filed: Nov. 4, 2002

(51) Int. Cl.[7] ..... H01R 9/05
(52) U.S. Cl. ..... 439/578; 439/583; 439/584
(58) Field of Search ..... 439/578–585; 174/71 C, 75 C, 82

(56) References Cited

U.S. PATENT DOCUMENTS

| | | | | |
|---|---|---|---|---|
| 5,024,606 A | 6/1991 | Ming-Hwa | 439/578 |
| 5,123,860 A | 6/1992 | Kamei et al. | 439/462 |
| 5,435,745 A | 7/1995 | Booth | 439/584 |
| 5,501,615 A | 3/1996 | Inaba et al. | 439/578 |
| 6,027,373 A | 2/2000 | Gray et al. | 439/578 |
| 6,095,828 A | 8/2000 | Burland | 439/98 |
| 6,146,208 A | 11/2000 | Pennell | 439/675 |
| 6,210,222 B1 | 4/2001 | Lamgam et al. | 439/583 |
| 6,331,123 B1 | 12/2001 | Rodrigues | 439/584 |

*Primary Examiner*—Michael C. Zarroli
(74) *Attorney, Agent, or Firm*—Maurice L. Miller, Jr.

(57) ABSTRACT

Connectors for forming an end electrically accessible termination on a center conductor and for electrically accessing an outer conductor of a conventional coax cable are disclosed. The use of such connectors with conventional triaxial cable in a low frequency three-phase electrical power supply application is also disclosed. The connector for accessing an intermediate conductor in a triaxial cable and for accessing an outer conductor in either a coaxial or triaxial cable features a flanged base member and a flanged cover member disposed over the base member wherein an exposed end portion of the conductor being accessed is trapped between the members, preferably including between their flanges. The flange of one of the members is folded over the flange of the other one of the members and crimped, as with a suitable crimping tool, to secure the members together with the conductor tightly sandwiched between them to form a low resistance connection between the conductor and the cover member.

12 Claims, 4 Drawing Sheets

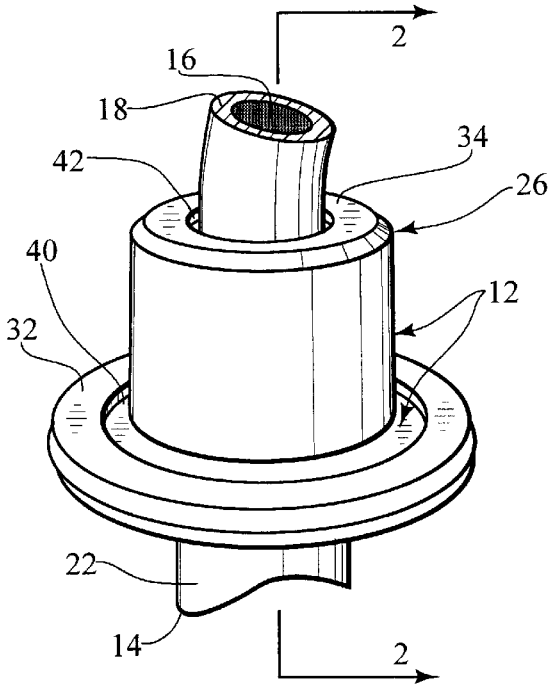
FIG. 1
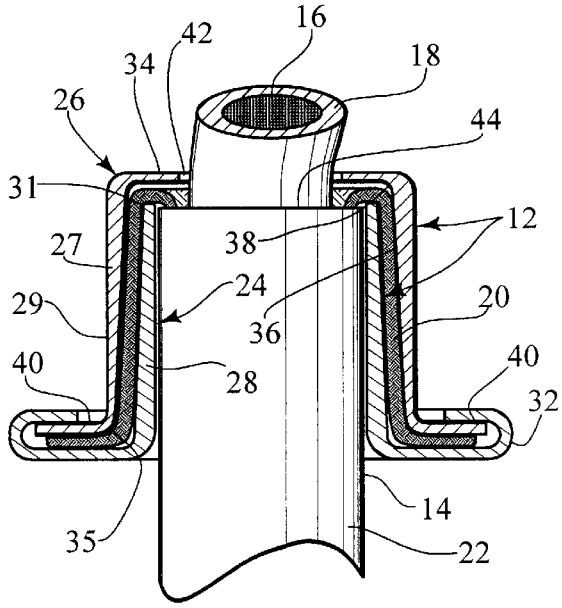
FIG. 2
FIG. 3
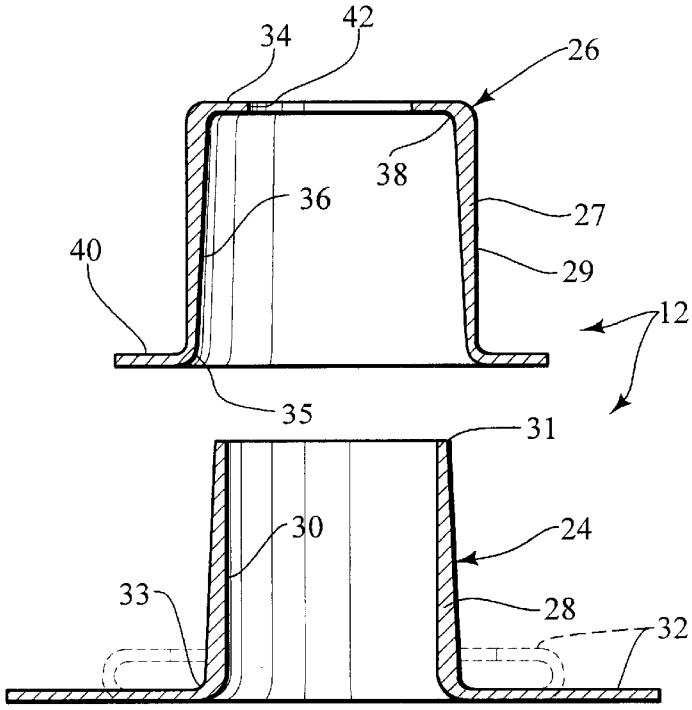

FIG. 6
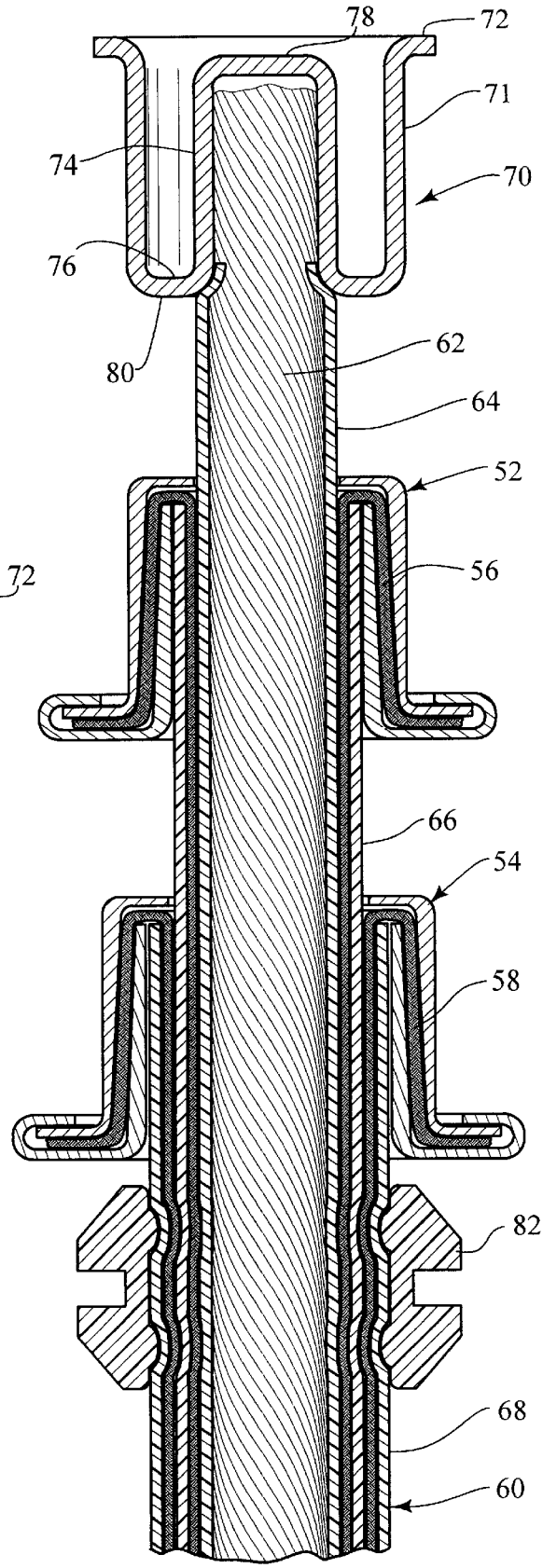
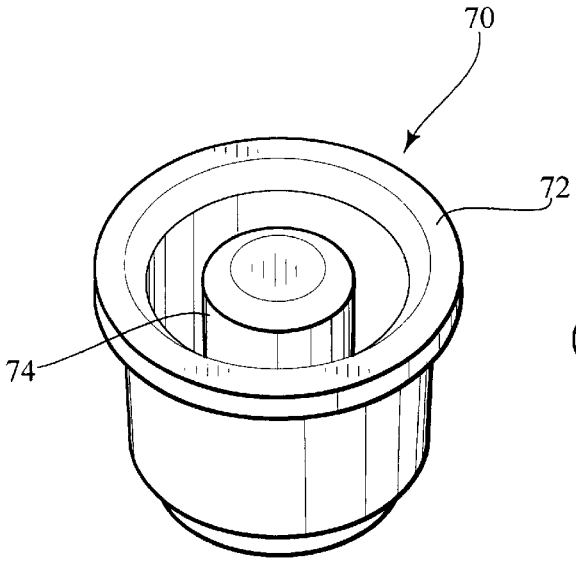
FIG. 7

ELECTRICAL CONNECTOR FOR COAXIAL CABLE

BACKGROUND OF THE INVENTION

This invention relates generally to an electrical connector for electrically accessing only a single conductor of a multi-conductor coaxial cable. More specifically, the invention relates to such a connector which includes a flanged cover member which fits over and around a flanged base member wherein at least one of two opposing curved surfaces of the members is tapered and wherein a flange on one of the members can be folded and crimped over and around an opposing flange of the other one of the members to secure the members together with an exposed concentric conductor of the cable being trapped therebetween in a low resistance electrical contact with the cover member.

With research ongoing in the field of electrical power supply and transmission in electrically powered automobiles and other vehicles, there is a perceived need for a heavy duty connector for use in accessing a concentric conductor in a coaxial or triaxial cable which can handle high electrical current. Electrically powered vehicles have been proposed which operate with d.c. or low frequency single or three-phase a.c. electrical power systems to operate a motor for driving vehicle wheels. In such systems, coax connectors are needed which can handle up to 200 amperes of electrical current and more. Radio frequency type coax connectors long known and used in the prior art are typically rated at about 3 to 5 amps. maximum. In typical use, such prior art connectors provide access at the end of a cable to both a concentric braid conductor and a center conductor, except that the concentric conductor is usually grounded to the vehicle frame at both ends of the cable such that it is not normally used as a current carrying member. In typical use, the concentric conductor is merely an r.f. shield for blocking spurious radio interfering noise signals carried on the center conductor.

A problem that occurs, when using a concentric conductor of a coaxial cable as a high current carrying member, is in obtaining a suitable low resistance contact between the conductor and a connector used to electrically access the conductor. A high resistance contact with such a high current carrying conductor can result in power loss and overheating of the cable in the vicinity of the contact between the connector and the concentric conductor.

It would therefore be desirable to provide a connector for a current carrying concentric conductor of a coaxial or triaxial cable having a high current carrying capacity which is capable of providing a suitably low resistance connection. It would also be desirable to provide such a connector wherein a concentric conductor in a coaxial cable can be electrically accessed at a substantially different position along the cable than at an end position wherein a center conductor of the cable is to be accessed.

By means of the present invention, these and other shortcomings of prior art coax connectors are substantially eliminated.

BRIEF DESCRIPTION OF THE DRAWINGS

FIG. 1 shows a perspective view of an electrical connector for electrically accessing the braid or shield of a coaxial cable, thus illustrating a preferred embodiment of the present invention.

FIG. 2 shows a cross-sectional view of the connector of FIG. 1 as viewed along cross-section lines 2—2 of the latter mentioned figure.

FIG. 3 shows an exploded cross-section view of the connector of FIGS. 1–2, the same as viewed in FIG. 2 but with the coaxial cable of FIGS. 1–2 being removed.

FIG. 6 shows a cross-section of the triaxial cable, connectors and termination of FIG. 5 with housing, spring clips and bus bars removed.

FIG. 7 shows a perspective view of the termination of FIGS. 5–6.

DESCRIPTION OF THE PREFERRED EMBODIMENTS

Figure 4:
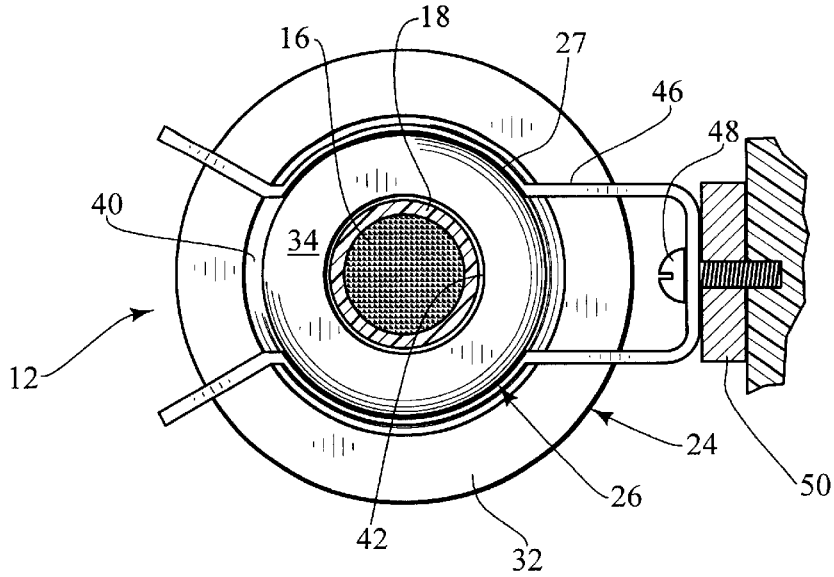
FIG. 4 shows an axial view of the connector and cable of FIGS. 1–2, the connector being attached to a conventional spring clip mounted on an electrical bus bar.

Referring now to the drawing figures and, in particular to FIGS. 1–3, there is shown in a preferred embodiment of the present invention, an electrical connector, generally designated 12, for use on a coaxial cable 14 (FIGS. 1–2 only). The cable 14 is of conventional type and includes a center electrical conductor 16, such as a copper or copper clad steel wire or strands of such wires, surrounded by a dielectric layer 18. The cable 14 also includes a concentric electrical conductor 20 which may be in the form of a foil, a braid of wires, as is typical in radio frequency applications, or strands of wires, as is typical in d.c. and low frequency, single phase and three phase electrical power applications. The conductor 20 surrounds the dielectric layer 18 of the center conductor 16. Finally, the cable 14 includes an outer insulation jacket 22 which surrounds the conductor 20. The connector 12 is adapted to provide electrical access to the conductor 20 in the manner shown best in FIG. 2.

An end portion of the cable 14 can be prepared for application of the connector 12 thereto in a usual and well known manner by first stripping away the insulation jacket 22 and the concentric conductor 20 to expose a selected length of the center conductor 16 and surrounding dielectric layer 18 on an end portion of the cable. The exposed center conductor 16, surrounded by the dielectric layer 18, will then project a desired distance beyond the end of the remaining concentric conductor 20 and the surrounding insulation jacket 22. Next, a selected length of an end portion of the remaining insulation jacket 22 is stripped away to expose that length of the concentric conductor 20. Now, following the mounting of a base member, generally designated 24, of the connector 12 over the exposed length of the center conductor 16 and its surrounding dielectric layer 18 and over and proximally beyond the exposed length of the concentric conductor 20, as later more fully explained, the exposed concentric conductor can then be folded proximally away from the dielectric layer 18 to be captured in the connector. The resulting exposed end portion of the center conductor 16 and surrounding dielectric layer 18 will then project distally out of and beyond a distal end of the connector 12 for connection to a center conductor end termination or end connector such as shown in FIG. 7 and as later more fully explained.

The connector 12 comprises two parts, one part being the base member 24 (See FIGS. 2–3), and the other part being a cover member, generally designated 26. The members 24, 26 are constructed of any suitable electrically conductive material such as, for example, copper or aluminum. In the present example, the base member 24 includes a hollow barrel 28 having an exterior surface forming a truncated cone of preselected taper wherein an outside diameter of the barrel at a distal end 31 is less than an outside diameter of the barrel at a proximal end 33. The barrel 28 includes an interior surface 30 which defines a cylindrically shaped passageway communicating with and extending axially between an opening at the proximal end 33 and an opening on the distal end 31. The interior surface or passageway 30 is sized to receive the fully jacketed coaxial cable 14 therein, in slidable and, preferably, close fitting relationship therewith, as best seen in FIG. 2. The exposed end portion of the concentric conductor 20 is folded over and around the distal end of the barrel 28 so as to extend proximally along and essentially evenly around the exterior tapered surface of the barrel. The base member 24 also includes a bendable or deformable annularly shaped base flange 32 which is attached to and around the barrel 28 so as to project radially outwardly from the barrel essentially in the plane containing the opening on the proximal end 33. See a bent portion of the base flange 32 as shown in phantom in FIG. 3.

The cover member 26 includes a hollow neck 27 having an exterior surface 29 forming a circular cylinder with and including end wall 34 on a distal end thereof. The neck 27 includes an open proximal end 35 and an interior surface 36 forming a truncated cone which is tapered, preferably, in conformity with the exterior surface taper of the barrel 28 of the member 24, wherein an inside diameter of the neck at an interior distal end 38 is less than an inside diameter of the neck at the open proximal end 35. The interior surface of the neck 27 is sized to fit over the barrel so as to tightly capture the exposed concentric conductor 20 between the members 24, 26 as shown in FIG. 2. The cover member 26 also includes an annularly shaped cover flange 40 attached to and extending radially outwardly around the open proximal end 35 of the neck 27. The end wall 34 defines an axially central circular opening 42 sized to permit the exposed dielectric layer 18 and center conductor 16 to extend therethrough, preferably in close conforming relationship. See FIGS. 1–2.

To apply the connector 12 to the cable 14, the latter being prepared as previously explained, the base member 24 is guided, proximal end 33 first, over the end of the exposed length of the dielectric layer 18. Thereafter, the base member 24 is guided, proximally, along the exposed dielectric layer 18 and the exposed concentric conductor 20, then closely extending, distally, along and around the dielectric layer, until an end 44 of the jacket 22 is approximately even with the distal end 31 of the base member. See FIG. 2. Next, the exposed end portion of the concentric conductor 20 is folded proximally over the tapered exterior surface of the barrel 28, preferably to such an extent that an end portion of the concentric conductor extends radially outwardly from the barrel over and around a radially inner portion of the base flange 32. Thereafter, the exposed dielectric layer 18 surrounding the center conductor 16 is guided though the opening 42 of the cover member 26 as the latter is guided, proximal end 35 first, over the folded concentric conductor 20 and base member 24, preferably such that the cover flange 40 bears against an end portion of the exposed concentric conductor 20 to trap the same securely against the base flange 32. Finally, a radially outer portion of the base flange 32 is folded distally over a radially outer edge portion of the cover flange 40 and is crimped in the folded position, as shown in phantom at 32 in FIG. 3, to securely and tightly trap an end portion of the folded concentric conductor 20 between the flanges 32 and 40 as shown in FIG. 2. The crimp connection between the flanges 32 and 40 not only renders members 24 and 26 mechanically tightly secured together but also assures a tight, low resistance contact between the concentric conductor 20 and the cover member 26, not only between the flanges, but also along, around and between the conformingly tapered opposing surfaces of the barrel 28 and the neck 27 of the members 24 and 26, respectively.

In the present example of the invention, since the base flange 32 is to be bent or folded distally over the cover flange 40 to secure the members 24, 26 together, it will be necessary for the radial dimension of the base flange to be substantially greater than the radial dimension of the cover flange 40, as seen by comparison of those flanges in FIG. 3. See also the base flange 32 folded and crimped over the cover flange 40 in the assembled connector 12 of FIG. 2. While this, arrangement is preferred, there is no reason why the cover flange 40 could not have a radial dimension which is substantially greater than the radial dimension of the base flange 32 such that the cover flange could be folded proximally around and over the base flange to secure the members 24, 26 together with the concentric conductor 20 tightly sandwiched, not only between the neck 27 and barrel 28, but, preferably, also between the flanges as shown. This alternative arrangement would produce essentially the same result as in the preferred embodiment and is intended to be within the scope of the invention.

Referring now also to FIG. 4, a distal end view of the assembled connector 12 is shown, with the neck 27 of the cover member 26 being fastened within a standard electrically conductive spring clip 46. The spring clip 46 is fastened, as by means of a machine screw 48, to an electrical bus bar 50 to provide electrical access between the bus bar and the concentric conductor 20 of the cable 14 of FIGS. 1–2. Note that the cylindrically shaped exterior surface 29 (FIG. 3) of the cover member 26 is readily adapted for attachment of the spring clip 46.

Referring now to FIG. 6, there is shown a pair of connectors, generally designated 52, 54, connected for remote electrical access to an intermediate conductor 56 and an outer concentric conductor 58, respectively, of a conventional triaxial cable 60 such as is typically used in low frequency, three phase electrical power transmission applications. The cable 60 includes a center conductor 62 surrounded by a dielectric layer 64. An intermediate insulating layer 66 surrounds the intermediate concentric conductor 56 and an outer insulation jacket 68 surrounds the outer concentric conductor 58, all in a usual and well known manner. The connectors 52, 54 are identical in construction to the connector 12 of FIGS. 1–4. But, since the connector 54 must, necessarily, fit over and surround the outer cable jacket 68, whereas the connector 52 fits over and surrounds the intermediate insulation layer 66, the connector 54 must, necessarily, be larger in all of its radial dimensions than those of the connector 52. Compare the relative sizes of the connectors 52, 54 in FIG. 6.

Referring now to FIGS. 6–7, an end termination or center conductor connector, generally designated 70, of the present invention is shown. The connector 70 is adapted for connection to the center conductor 62. It, of course, may also be properly sized for use as an end termination for a center conductor of a standard coaxial cable such as the center conductor 16 of the cable 14 as previously explained in relation to FIGS. 1–4. To apply the end connector 70 to a distal end portion of the center conductor 62, it is first necessary to strip the dielectric layer 64 away from the center conductor along that end portion. The end connector 70 includes a cylindrically shaped bowl 71 open on a distal end thereof (the upper end as viewed in FIG. 6), which distal end contains a radially outwardly flared and annularly extending shoulder 72. A central interior of the bowl 71 contains an axially extending, cylindrically shaped hollow projection 74 which extends distally from a base 76 of the bowl. The central projection 74 contains a closed distal end 78 which is recessed proximally from the distal end surface of the shoulder 72. See FIG.6. The projection 74 is open on a proximal end 80 of the connector 70, which opening and hollow interior of the projection is sized to receive an exposed end portion of the center conductor 62 in close fitting relation. After the end connector 70 is applied over the center conductor 62, the projection 74 is crimped around it's perimeter to tightly confine the end conductor therein. Since such crimping may tend to cause the distal end 78 to creep in the distal direction, recessing of the distal end 78 initially may be important to keep the distal end from creeping to a position distally beyond the shoulder 72.

Figure 5:
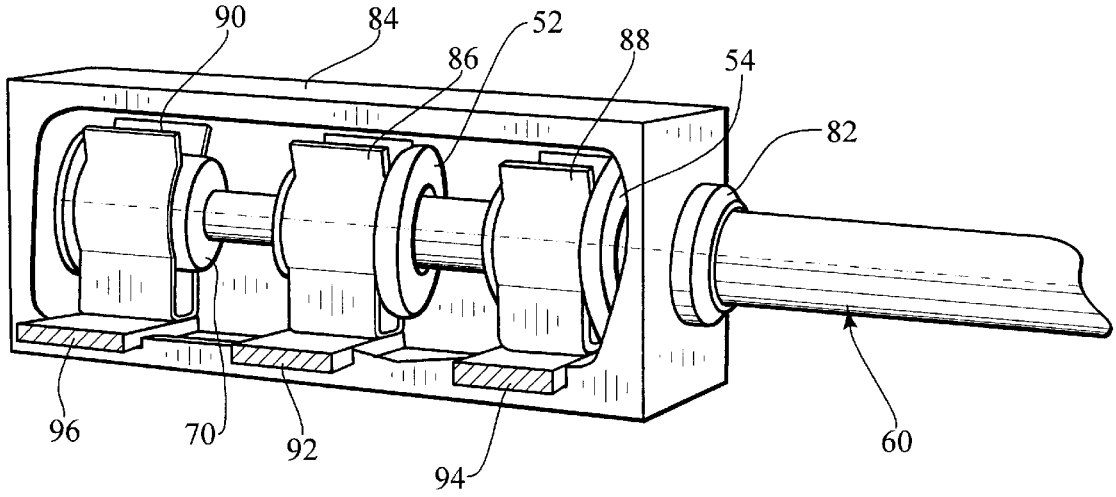
FIG. 5 shows a perspective view of a housing containing two connectors and an end termination connected to inner and outer braids and a center conductor, respectively, of a triaxial cable, the connectors and termination being in accordance with the present invention and being separately connected to spring clips mounted on separate bus bars.

Referring now also to FIG. 5, the cable 60 is shown extending through a standard grommet 82 into one end of a suitable electrically insulating housing 84 which contains the intermediate and outer conductor connectors 52, 54 and the end termination or connector 70. Standard spring clips 86, 88 and 90 are separately attached to connectors 52, 54 and 70, respectively, and are, in turn, mounted on and in electrical contact with electrically separate bus bars 92, 94, and 96, respectively. Note in FIGS. 5–6 that the connectors 52, 54 and 70 are spaced apart from one another along the cable 60 to prevent electrical contact between them. The minimum spacing to be provided between them will depend on the voltage levels being dealt with in the cable 60 and will likely be controlled by applicable electrical codes.

Figure 8:
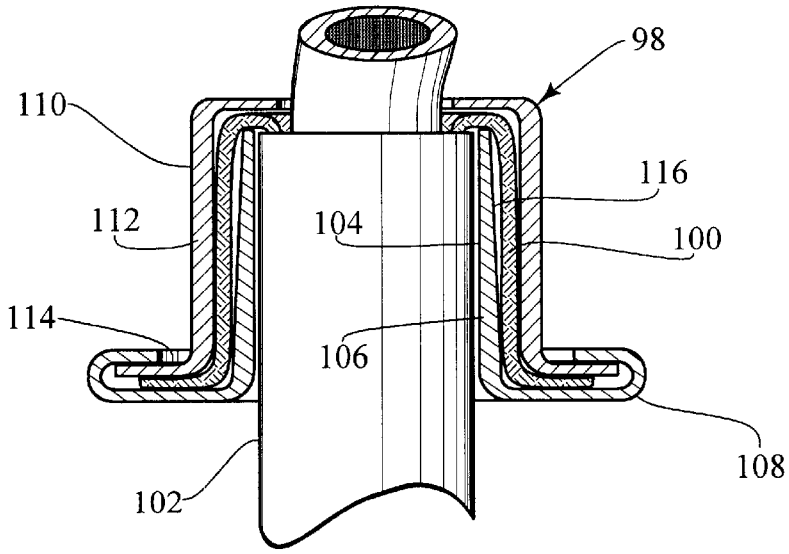
FIG. 8 shows a cross-sectional view of another important embodiment of the connector of the present invention with cable therein shown in full.

Referring now to FIG. 8 there is shown, in another important embodiment of the invention, a connector, generally designated 98, for electrically accessing concentric conductor 100 of a conventional coaxial cable 102. The connector 98 can also be sized for electrically accessing either an outer or intermediate conductor of a conventional triaxial cable. As in the case of the connector 12 of FIGS. 1–4, the connector 98 includes a base member 104, having a barrel 106 and an attached base flange 108, and a cover member 110 having a neck 112 and an attached cover flange 114. In the present example, an exterior surface 116 of the base member barrel 106 is configured in the shape of a truncated cone, as in the previous examples, but the cover member neck 112 is cylindrically shaped on both its interior and exterior surfaces. The cover member 110 is sized so as to fit over the base member 104 and pinch the outer conductor 100 between at least proximal end portion of the barrel 106 and neck 112. Also, as in the example of FIGS. 1–4, an end portion of the conductor 100 is, preferably, tightly sandwiched between the base flange 108 and the cover flange 114. Here, again, the base flange 108 is sized to permit it to be bent or folded distally over the cover flange 114 to secure the members 104, 110 together. But the reverse is permissible, wherein the cover flange 114 is sized to permit it to be folded proximally over and around the base flange 108.

Figure 9:
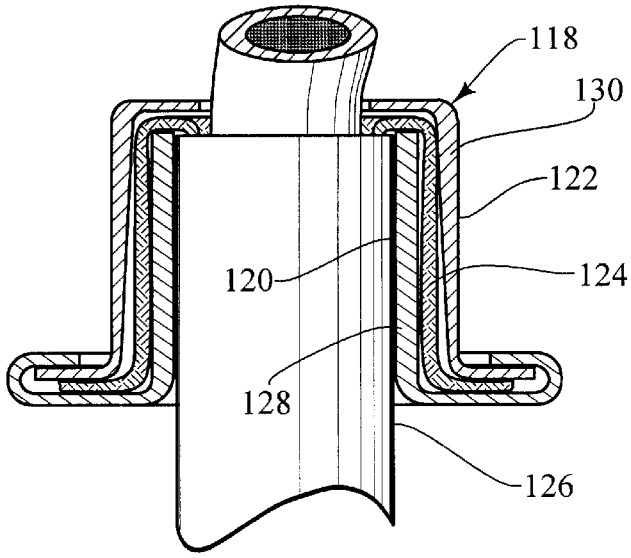
FIG. 9 shows a cross-sectional view of yet another important embodiment of the connector of the present invention with cable therein shown in full.

Referring now to FIG. 9, another example of a connector, generally designated 118, of the present invention is shown which includes a flanged base member 120 and a flanged cover member 122 covering and secured to the base member with a concentric conductor 124 of a coaxial cable 126 sandwiched therebetween. In this example, a barrel 128 of the base member 120 is cylindrically shaped on both of its internal and external surfaces, whereas the cover member 122 contains a neck 130 which is cylindrically shaped on its exterior surface 122, for attachment to a spring clip or the like, but is tapered to form a truncated cone shaped interior. The cover member 122 is sized to fit over the base member 120 so as to pinch a portion of the outer conductor 124 between opposing distal end portions.

In the example of FIGS. 1–3, wherein opposing surfaces of the barrel 28 and neck 27 are tapered, it is preferable that they each be tapered by essentially the same amount so as to be in conformity with each other. The amount of taper should be no less than will permit the cover member 26 to be applied over the proximally folded conductor 20 and the underlying base member 24. Also, the amount of taper should not be so large as to cause potentially damaging rubbing and scraping of the cover member neck 27 against the conductor 20 as the cover member 26 is applied over the base member 24. In actual tests with connectors, such as at 12 in FIGS. 1–3, having axial dimensions of about 18.35 mm, an effective range of such tapers has been found to be from about 5 percent up to about 11 percent with an optimum taper being about 7–8 percent, assuming a worst case scenario wherein the material of which the connectors are made is harder and less deformable than the material of which the conductor 20 is made. Where the material of which the connector 12 is made has relatively thin walled members 24, 26 or otherwise has some deformable character when applied together on the cable 14, it should be possible to extend the upper limit of the taper of the opposing surfaces of the barrel 28 and neck 27 above 11 percent without incurring damage to the exposed conductor 20. Also, for a connector 12 having an axial dimension substantially less than 18.35 m, it should be possible to increase the amount of taper of the barrel 28 and neck 27 substantially above 11 percent, again, assuming the worst case wherein the cover member 26 is composed of a harder material than that of the conductor 20, without incurring damage to the strands of the conductor during assembly of the members 24, 26 on the cable 14.

It should be appreciated that, where the members 24, 26 include opposing tapered surfaces within an effective range of tapers as previously explained, it is not essential that end portions of the conductor 20 be trapped between the flanges 32 and 40, although it is preferable. Effective opposing tapers of the members 24, 26 will permit an essentially uniform bearing pressure of the cover member 26 against the conductor 20 between proximal and distal ends of the barrel 28 and neck 27 to yield a satisfactory low resistance contact between the conductor and cover member. But, having the additional contact of end portions of the conductor 20 between the flanges 32 and 40 as shown in FIGS. 1–3, provides additional contact between the cover member 26 and the conductor for achieving the lowest practical resistance connection.

As used herein, the term, concentric conductor, applies to the outer conductor of a standard two conductor coaxial cable or to the intermediate conductor in a standard three conductor triaxial cable. Further, unless the context otherwise requires, the term, coaxial cable, as used herein, applies to both two conductor and three conductor cables which contain a center conductor and one or more concentric conductors surrounding a center conductor.

Although the present invention has been described with respect to specific details of a certain preferred embodiment and other important embodiments thereof, it is not intended that such details limit the scope and coverage of this patent other than as expressly set forth in the following claims, making allowance for equivalent structures.

I claim:

1. An electrical connector for electrically accessing a concentric conductor surrounding an insulated center conductor of a coaxial cable, said connector comprising an electrically conductive base member including a hollow barrel defining a cylindrically shaped passageway extending between an open proximal end an open distal end, said passageway and each said open end being sized to closely and slidably fit an insulation layer surrounding the concentric conductor of the cable, said base member further including an annularly extending base flange attached to and around said barrel at said proximal end;

an electrically conductive cover member including a hollow neck defining a cylindrically shaped, axially extending exterior surface and having a partially closed distal end defining a central circular opening sized for passing therethrough only an insulated central portion of the cable which projects from within the center conductor, a proximal end of said neck being open, said cover member further including an annularly shaped cover flange attached to and around the proximal end of said neck, said cover member being sized to fit over and concentrically around said base member with said cover flange and said base flange being in opposing relationship and with an exposed end portion of said concentric conductor trapped between opposing surfaces of said base member and cover member, a radially outer end portion of one said flange being bendable around and over an outer end portion of another said flange to secure said cover member and base member together with said exposed end portion of said concentric conductor sandwiched between said neck and said barrel, at least one opposing surface of said neck and barrel being tapered to assure a tight, low resistance contact between said exposed concentric conductor and said cover member along at least a portion of the axial length of said neck.

2. A connector for electrically accessing a concentric conductor surrounding an insulated center conductor of a coaxial cable, said connector comprising an electrically conductive base member including a hollow barrel having an exterior surface forming a truncated cone of preselected taper wherein an outside diameter of said barrel at a distal end thereof is less than an outside diameter of said barrel at a proximal end thereof, said barrel having an interior surface defining a cylindrically shaped passageway communicating with and extending axially between an opening on said proximal end and an opening on said distal end, said passageway being sized to receive an insulated layer surrounding the concentric conductor therein, the cable being prepared by removing an outer insulation layer thereof above the distal end opening to expose a concentric conductor and by folding the exposed concentric conductor proximally over and around the distal end so that the folded exposed concentric conductor lies over and around the tapered exterior surface of said barrel;

an annularly shaped base flange attached to and around said barrel and projecting radially outwardly from said barrel essentially in a plane containing the proximal end opening; and an electrically conductive cover member including a hollow neck having an exterior surface forming a cylinder with an end wall on a distal end thereof, said neck having an open proximal end and an interior surface forming a truncated cone tapered in conformity with the exterior surface taper of said barrel wherein an inside diameter of said neck at an interior distal end thereof is less than an inside diameter of said neck at said open proximal end, the interior of said neck being sized to fit over said barrel to capture the folded concentric conductor between the cover member and the base member; and a cover flange attached to and extending radially outwardly around said open proximal end of said neck, said base flange having a radially outer portion which can be folded and crimped over a distally facing surface portion of said cover flange for securing said cover member over said base member to enclose said folded concentric conductor between at least a portion of the opposing surfaces of said base member and said cover member, said end wall defining a circular opening therein which is sized to permit an insulated central portion of the coaxial cable which extends from within the concentric conductor to pass therethrough.

3. An electrical connector for electrically accessing a concentric conductor of a coaxial cable comprising an electrically conductive base member including a hollow barrel defining a cylindrically shaped passageway opening onto a proximal end and an opposite distal end of said barrel, said barrel being sized to slidably fit over an insulation layer immediately surrounding the concentric conductor to be accessed, said base member further including an annularly extending base flange attached to and around the proximal end of said barrel; and an electrically conductive cover member including a hollow neck which is open on a proximal end and which contains an end plate partially covering a distal end of said neck, which plate defines a central opening, said cover member further including an annularly extending cover flange attached to and around the proximal end of said neck, said cover member being sized to fit over and concentrically about said base member with an exposed end portion of the concentric conductor being trapped between opposing surfaces of said base member and said cover member, a radially outer end portion of one said flange being bendable over and around the perimeter of another said flange for crimping so as to secure said cover member on said base member and for providing electrical contact between the concentric conductor and said cover member.

4. The connector of claim 1 wherein said base flange and said cover flange are integrally connected with said barrel and said neck, respectively.

5. The connector of claim 1 wherein the exterior surface of the barrel of said base member is tapered to form a truncated cone such that an outside diameter of the distal end of said barrel is less than an outside diameter of the proximal end of said barrel at the position of joinder of said barrel with said base flange.

6. The connector of claim 1 wherein the interior axially extending surface of said neck is tapered to form a truncated cone such that an inside an inside diameter of said neck at an interior distal end thereof is less than an inside diameter at an interior proximal end thereof.

7. The connector of claim 1 wherein opposing surfaces of said barrel and neck, when said cover member is operatively positioned over and concentrically around said neck member, are both tapered in conformity with one another so as to be essentially parallel with one another everywhere between the distal end proximal ends of said opposing surfaces when said base member and said cover member are operatively assembled.

8. The connector of claim 1 wherein a radial dimension of said base flange is sufficiently greater than that of said cover flange such that, upon placement of said cover member over and around said base member, a radially outer end portion of said base flange can be bent over and around the perimeter of said cover flange and crimped to secure said cover member in an operative position over and around said base member with an exposed end portion of said concentric conductor being tightly sandwiched between opposing surfaces of said base member and cover member with said with said exposed end portion being in electrical contact with said cover member.

9. The connector of claim 1 wherein the closed distal end of said projection is recessed from said shoulder prior to crimping of said projection against said exposed center conductor.

10. In combination with a length of coaxial cable of the type which includes a center conductor and at least one concentric conductor electrically insulated from and surrounding said center conductor, a pair of electrical connectors comprising an end termination connector electrically connected to an end portion of said center conductor for electrically accessing the center conductor of said cable; and a concentric conductor connector connected to a concentric conductor of said cable for electrically accessing said concentric conductor and including an electrically conductive base member Including a hollow barrel defining a cylindrically shaped passageway opening onto a proximal end and an opposite distal end of said barrel, said barrel being sized to slidably fit over an insulation layer immediately surrounding the concentric conductor to be accessed, said base member further including an annularly extending base flange attached to and around the proximal end of said barrel; and an electrically conductive cover member including a hollow neck which is open on a proximal end and which contains an end plate partially covering a distal end of said neck, which plate defines a central opening, said cover member further including an annularly extending cover flange attached to and around the proximal end of said neck, said cover member being sized to fit over and concentrically about said base member with an exposed end portion of the concentric conductor being trapped between opposing surfaces of said base member and said cover member, a radially outer end portion of one said flange being bendable over and around the perimeter of another said flange for crimping so as to secure said cover member on said base member and for providing electrical contact between the concentric conductor and said cover member.

11. The combination of claim 10 wherein said end termination connector comprises a bowl shaped member having a cylindrically shaped, axially extending surface and being open on a distal end thereof, said member having a base on a proximal end thereof, said member including a hollow cylindrically shaped projection extending distally from a central circular interior surface of said base, said projection being closed on a distal end thereof and open on a proximal end thereof for receiving an end portion of an exposed center conductor of a coaxial cable within said projection, said projection being crimpable on and against said center conductor portion.

12. The connector of claim 11 wherein said bowl includes an annularly extending shoulder on said distal end.

* * * * *